United States Patent [19]

Kinkopf

[11] 4,098,320

[45] Jul. 4, 1978

[54] INGOT STRIPPER STRUCTURE

[75] Inventor: Edward J. Kinkopf, Alliance, Ohio

[73] Assignee: The Alliance Machine Company, Alliance, Ohio

[21] Appl. No.: 739,438

[22] Filed: Nov. 8, 1976

[51] Int. Cl.[2] ..... B22D 29/08

[52] U.S. Cl. ..... 164/407

[58] Field of Search ..... 165/405, 407, 408, 131, 165/344

[56] References Cited

U.S. PATENT DOCUMENTS

| | | | |
|---|---|---|---|
| 713,029 | 11/1902 | Wellman et al. | 164/407 X |
| 1,760,054 | 5/1930 | George | 164/407 |
| 3,064,324 | 11/1962 | Schaper | 164/405 |

FOREIGN PATENT DOCUMENTS

| | | | |
|---|---|---|---|
| 422,823 | 1911 | France | 164/407 |
| 424,425 | 1911 | France | 164/407 |
| 153,167 | 1903 | Fed. Rep. of Germany | 164/407 |
| 1,031,241 | 6/1966 | United Kingdom | 164/405 |

*Primary Examiner*—Francis S. Husar
*Assistant Examiner*—John McQuade
*Attorney, Agent, or Firm*—Buell, Blenko & Ziesenheim

[57] ABSTRACT

An apparatus for stripping a metal ingot from its casting mold is provided in which mechanical stripping motion is provided by a stripping screw rotatable within a vertically extending column housing which is in turn rotatable within a column frame and in which the stripping screw provides control of the ingot and mold gripping tongs and a bull nose for ejecting ingots from a mold.

10 Claims, 8 Drawing Figures

Figure 1:
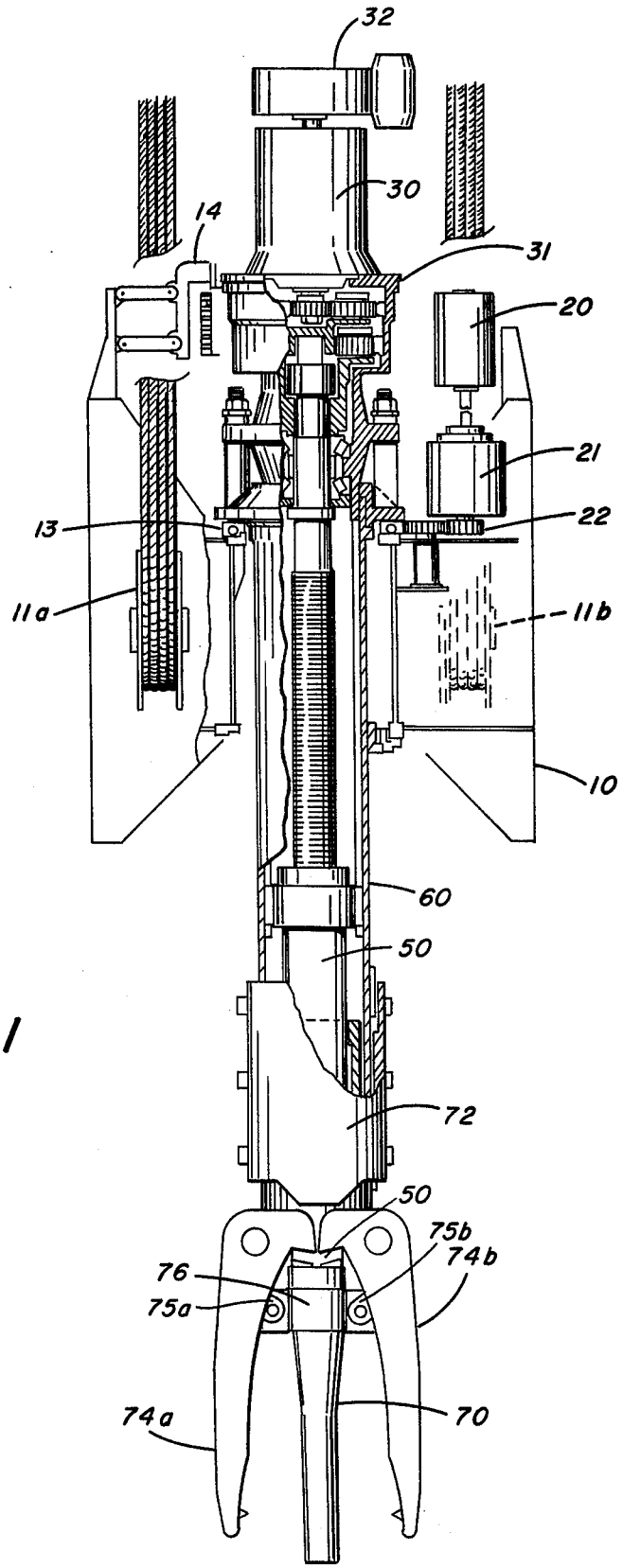

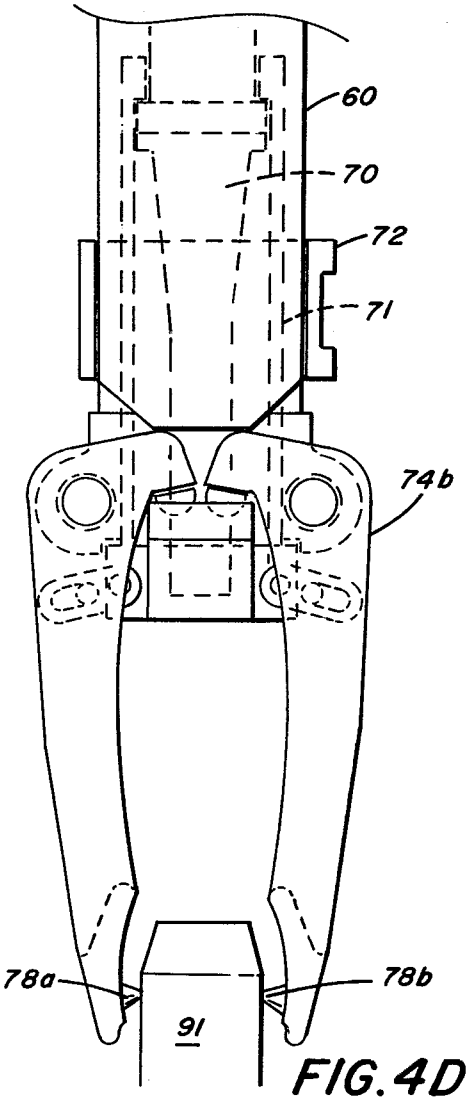
FIG. 4D
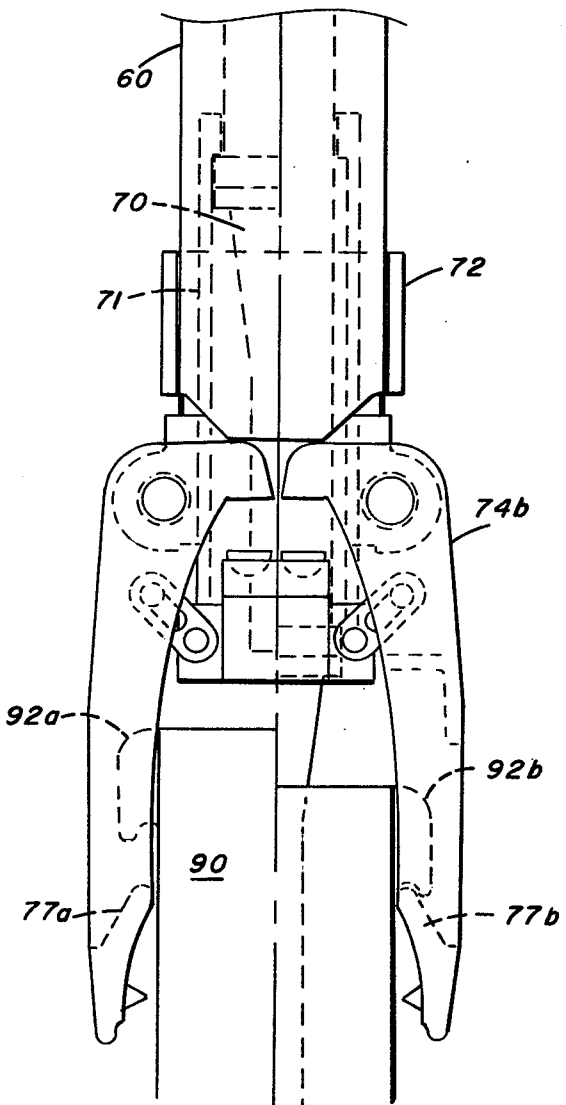
FIG. 4C
FIG. 4B
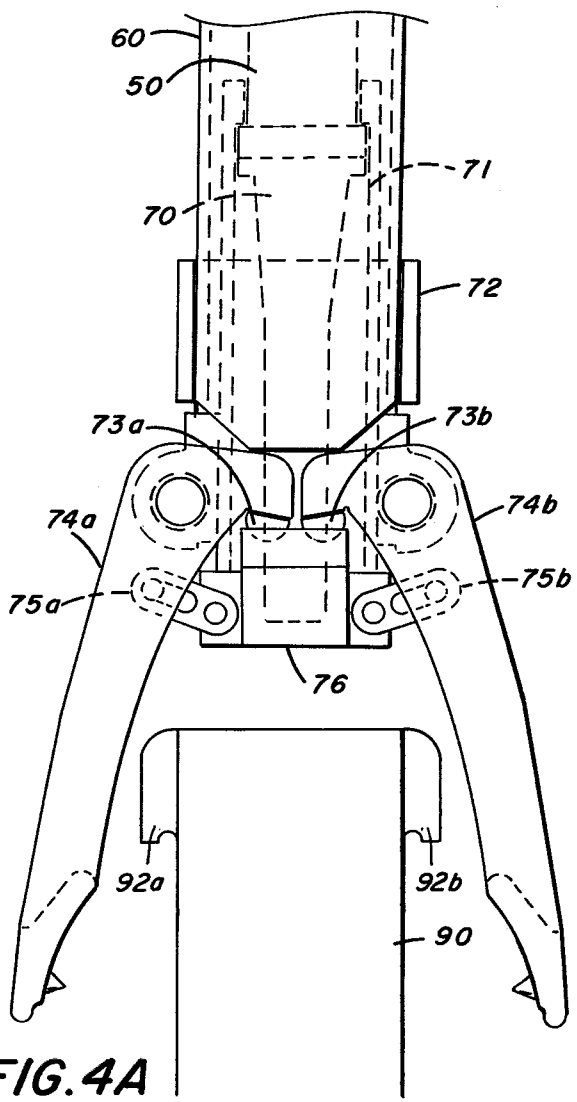
FIG. 4A

INGOT STRIPPER STRUCTURE

The present invention relates broadly to a mechanism suspended from a crane used to remove molds from cast steel ingots. Usually referred to as a stripper crane this mechanism is also used to position molds and ingots in conjunction with the casting operation. The stripping action is accomplished by a set of tongs to grip the ingot mold and a ram to expel the ingot from the mold.

An object of the present invention is to control to tongs by controlling the position of the ram. By adjusting the vertical position of the ram the operator can perform the following functions: open tongs, close tongs or molds, strip ingot and grip ingot.

Another object of this invention is to provide for complete rotation about the vertical axis of the tongs so that molds and ingots may be manipulated without regard to their initial position.

A further object of the present invention is that all of the various operations of the stripper are performed using one simple mechanical drive, thereby eliminating hydraulic, pneumatic and complex mechanical systems.

Steel ingots are formed by pouring or teeming molten steel into iron molds. As the steel cools and solidifies the ingot must be removed from the mold for further processing. The force required to extract the ingot can be exceedingly high due to the interior surface of the mold and other variables. To extract the ingot requires a firm grip on the mold via mold lugs and a powerful force on the ingot. Considering the size of the ingot and the forces involved the necessity for coordination between the stripper and the ingot mold becomes obvious. For this reason strippers are usually suspended from travelling overhead cranes. While this two dimensional movement allows the stripper to be positioned over the mold it does not necessarily allow the striper tongs to be aligned with the lugs on the mold. Nor does the crane alone allow for molds to be rotated so that the lugs are placed in a better position for future operations. The ability to rotate about a vertical axis the tongs allows the mold lugs to be engaged regardless of the mold's position. When the ingot stripper is used to transfer molds the rotation about the vertical axis allows the new line-up of molds to have any designated orientation of mold lugs.

To adequately lift molds, strip them and then transfer ingots requires the operator of the machine to accurately control the bull nose and tongs. The tongs must be operated with sufficient force to engage and disengage the mold lugs. Additional force and movement is required when the tongs are to be used to grip ingots.

Many different types of mechanical control exist to move the tongs, these include hydraulic cylinders, electric motors and cables with pulleys. These systems do not adapt to rotation of the column because of their hydraulic hoses, electric wires or cables. These systems require that both the power to move the tongs and the control intelligence to direct the movement of the tongs be transmitted along the outside of the column. These means of transmission necessitate either complex power transfer means such as slip rings or a limitation on the rotation of the tongs about the vertical axis. An object of my invention is that complete control and power for operating the tongs is derived from the positioning of the driven screw operating the ram. An additional object of my invention is to allow the tongs to be opened or closed independent of the column rotation.

Figure 2A:
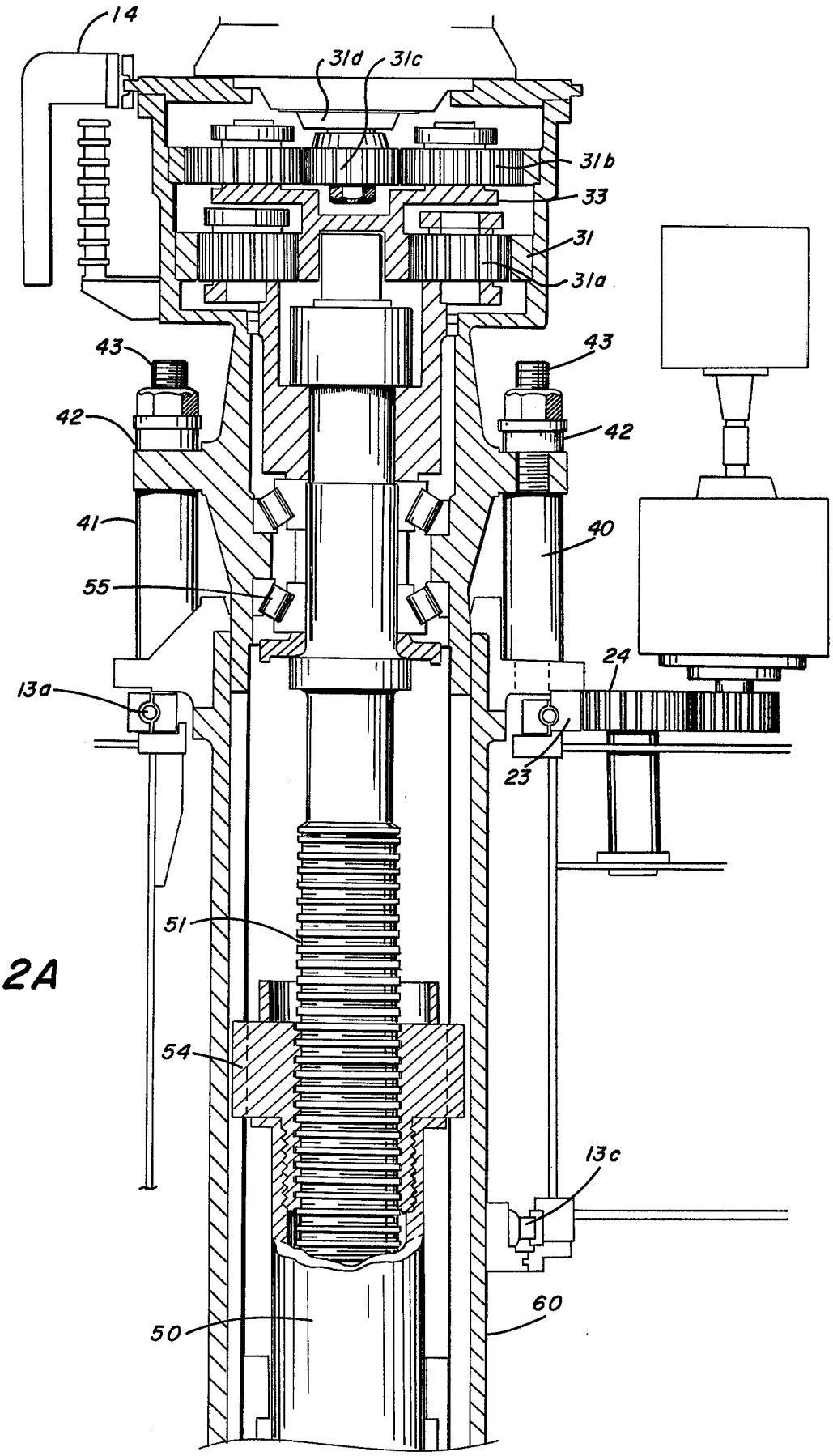
Figure 2B:
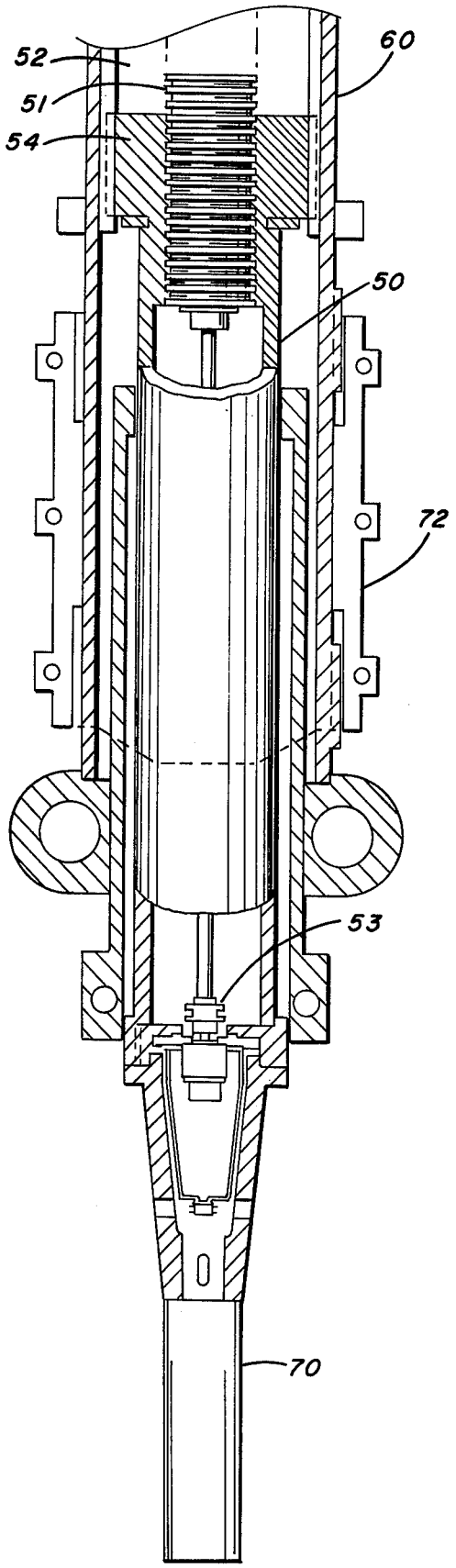
Figure 3:
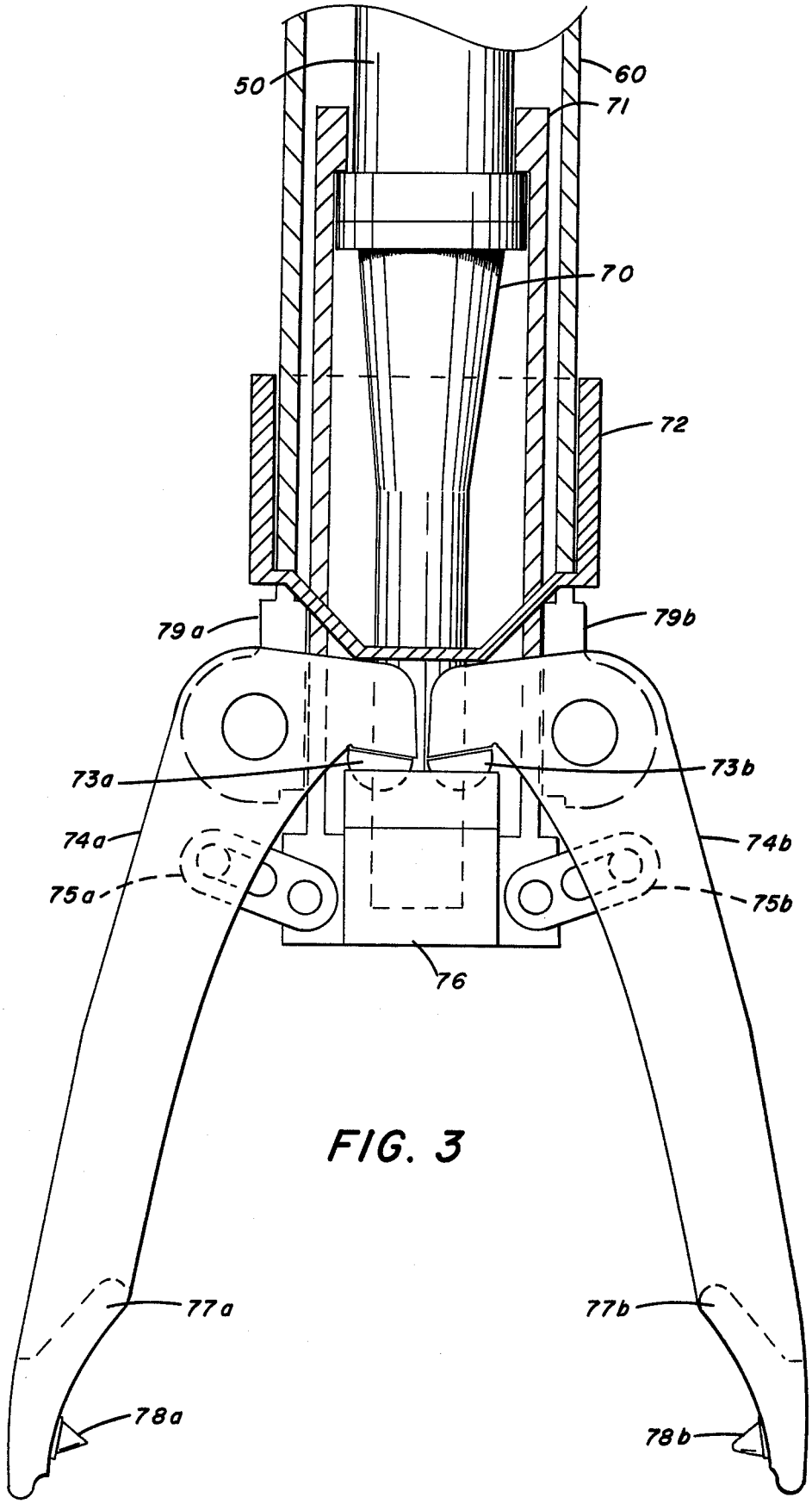

Additional objects and advantages will be apparent as the invention becomes better understood by reference to the continuing specification and accompanying drawings. In the accompanying drawings, I have shown a present preferred embodiment of the invention in which:

FIG. 1 is an elevational view of the ingot stripper as it would be suspended with some portion shown in cut-away;

FIG. 2*a* is an elevational view of the upper portion of the stripper column shown partially in relief;

FIG. 2*b* is an elevational view of the lower portion of the stripper column shown partially in relief;

FIG. 3 is an elevational view of the lower column and tongs shown in partial cross-section; and FIG. 4*a* shows the tongs open and the bull nose partially retracted, FIG. 4*b* shows the tongs closed and the bull nose slightly lowered, FIG. 4*c* shows the tongs closed and the bull nose fully extended and FIG. 4*d* shows the bull nose fully retracted and the tongs gripping an ingot.

The ingot stripper as shown in FIG. 1 is normally suspended from an overhead crane but it could be suspended from any support structure by cables to pulleys 11*a* and 11*b*. It is the operation of these pulleys which raises and lowers the ingot stripper allowing the mold or ingot to be raised or transported. The column frame 10 provides for support between these pulleys and the column housing 60. The column frame does not rotate but allows the column housing to rotate about a vertical axis within the column frame by means of column support bearings 13 and the column rotating gear 22. During operation the column can be rotated in either direction about its vertical axis by means of a column rotate motor 20, column rotate gear box 21 and the column rotate gear 22. This rotation is imparted to the column housing by means of the rotate pinion gear 24 and the main rotate gear 23 which is attached circumferentially to the column housing. Because the column housing rotates, all electric power and control signals are transmitted onto the column housing by means of electrical slip rings 14. Rotation of the column housing 60 also rotates the tongs 74*a* and 74*b* and all other structures attached to the column housing.

In reference to FIG. 2*a* there is shown the column housing 60 firmly attached but free to rotate about the vertical axis within the column frame 10 by column support bearings 13*a* and 13*c*.

The stripping screw 51 is mounted within the column housing and supported by the stripping screw bearing 55. The stripping screw bearings are mounted to the column housing by means of guide rods 43. Relative movement between the column housing 60 and the stripping screw 51 is provided for on the guide rods by the column springs 40 and 41 which compress during ingot gripping. Cushioning washers 42 absorb the energy from the column springs should an ingot be released suddenly.

The stripping screw is rotated by the vertical motor 30 acting through planetary gears housed in the planetary gear housing 31. The vertical motor is provided with a brake 32. The lower planetary gears 31*a* rotate on the drive hub 33 which is fixably attached by a key to the stripping screw. The upper planetary gears 31*b* rotate about the vertical gear 31*c* which is supported on sleeve bearing 31*d*. Mounted on the stripping screw is a non-rotating nut 54 which is keyed to the column housing 60 so that rotation of the stripping screw imparts vertical movement to the non-rotating nut.

Referring to FIG. 2*b*, attached to the non-rotating nut, is a ram extension 50 which imparts the stripping force to the bull nose 70 and engages the tong closing counterweight 71. The bull nose is used to penetrate into the mold and expel the ingot. Lubrication for the stripping screw and non-rotating nut is provided by means of an oil dam above the nut. A mechanical pump driven by the stripping screw supplies oil to the oil dam.

The tong opening counterweight 72 is mounted coaxially around the column housing and is free to move axially on the housing. Mounted pivotally on the column housing are two tongs 74*a* and 74*b*. The tongs are connected to the load beam 76 by means of tong connecting links 75*a* and 75*b*. The tong closing counterweight is attached to the load beam and fitted within the column housing so as to bear upon the bull nose and ram extension. The tong closing counterweight is free to move vertically upward within the column housing but is restrained in its downward movement by the engagement of the ram extension and bull nose. In operation the tong closing counterweight can be retracted by upward movement of the ram extension.

The tong opening counterweight is mounted so as to bear upon the tongs and maintain them in an open position. The load beam has mounted thereon in spherical cups two pressure shoes 73*a* and 73*b*. These pressure shoes can bear against the tong and pivot them closed. The pressure shoes are used to exert the force on the tongs when the stripper is used in the ingot gripping mode. The load beam has an opening permitting the bull nose to protrude through the beam and into the ingot mold.

In reference to FIGS. 4*a*, 4*b* and 4*c*, it can be seen that control to close the tongs while stripping an ingot mold is achieved by lowering the bull nose and ram extension which allows the tong closing counterweight to override the tong opening counterweight.

The movement exerted around the tong pivoting point by the tong opening counterweight should be sufficient to maintain the tongs opened while the tong closing counterweight 71 is not bearing upon the tong connecting links. As the bull nose is lowered as shown in FIG. 4*b* the tong closing counterweight 71 over balances the tong opening counterweight 72 as the load beam is lowered. Calculation of the weights required for both opening and closing counterweights take into account the weights and pivoting movements of the tongs, connecting links and load beam. The maximum force exerted on the ingot mold by the tong seat 77*a* and 77*b* is dependent upon the weights chosen for the counterweights and is independent of additional downward movement of the bull nose and ram.

Movement of the ingot stripping structure upward to engage the mold lug 92*a* with the tong seat 77*a* does not add additional force or imbalance to the tong 74*a*. As shown in FIG. 4*c* when the bull nose is fully extended into the mold and strips the ingot from the mold, the closing force exerted by the tong 74*b* remains the same during the stripping operation.

FIG. 4*d* shows the ingot stripping structure being used to power grip a steel ingot 91. In this mode of operation as the bull nose is retracted into the column housing by rotation of the stripping screw, the load beam 76 is pulled upward and the pressure shoes 73 contact the pivoted tong 74*b*. The tongs are forced closed as the pressure shoe overcomes the balance of the tong opening counterweight.

Using the upward force of the stripping screw as transmitted through the tong closing counterweight 71 to the load beam, the tongs are forced closed with a power grip. The force exerted on the ingot is a function of the rotation of the stripping screw. In this mode the rotation of the stripping screw while an ingot is engaged causes relative movement between the stripping screw and the column housing. Provision for this relative movement is provided for by means of the column springs 41 and 42 and the guide rods 43. As the column springs are compressed their force is transmitted through the stripping screw bearing 55 and the stripping screw 51 to the load beam. This force can be preset by means of a limit switch on the vertical column spring travel. To firmly grip the ingot provision has been made for gripping pins 78*a* and 78*b* attached to the lower end of the tong. To release an ingot from the power grip of the tong the operator reverses the rotation of the stripping screw which returns the column springs to their original position.

The preferred embodiment uses a cylindrical column with a cylindrical tong opening counterweight mounted outside of the column and a tubular tong closing counterweight mounted inside of the column. Other shapes of counterweights could be used or their respective positions interchanged.

Operation of the ingot stripper structure is as follows:

The ingot stripper structure is positioned over the mold to be stripped. The operator by controlling the column rotate motor 20 rotates the column 60 until the tongs 74*a* and 74*b* are aligned with the mold lugs. The bull nose 70 is now placed a few inches below its highest position so that the tong closing counterweight 71 is being fully supported by the ram extension 50. Only the tong opening counterweight 72 is bearing on the tongs so that the tongs are held full open. The ingot stripper structure is now lowered over the mold so that the tong lift seat 77*a* and 77*b* is below the mold lugs. The operator now begins to rotate the stripping screw 51 which gradually transfer the force of the tong closing counterweight 71 from the ram extension 50 to the tongs via the connecting links 75*a* and 75*b*. Once the tong closing counterweight 71 is fully supported by the connecting links 75*a* and 75*b* the closing force of the tongs 74*a* and 74*b* on the mold remains constant.

When the tongs 74*a* and 74*b* are closed the ingot stripper structure is raised allowing the tong lift seats 77*a* and 77*b* to engage the mold lugs 92*a* and 92*b* and the mold is raised from its stool. The operator now rotates the stripping screw 51 to further lower the bull nose 70 into the ingot 90. The force of the advancing stripping screw expels the ingot from the mold. The empty mold can now be transported and by use of the column rotation be placed in any lug orientation. To release the mold the operator need only retract the bull nose 70 by rotating the stripping screw 51 which raises the ram extension 50.

If the operator now wishes to transport or reposition the ingot he will position the ingot between the tongs and rotate the stripping screw to raise the ram extension to its highest point. This raises the load beam 76 causing the pressure shoes 73*a* and 73*b* to force the tongs closed on the ingot. As the tongs close on the ingot the column springs 40 and 41 compress until a predetermined force or displacement stops the rotation of the stripping screw 51. The ingot can now be transported and/or rotated.

While this invention has been described in connection with a preferred embodiment, it will be understood that it is not intended to limit the invention to the embodiment. On the contrary, it is intended to cover all alterations, modifications and equivalents as may be included within the spirit and scope of the invention as defined by the appended claims.

I claim:

1. An apparatus for stripping a metal ingot from its casting mold comprising:
   a. a column frame;
   b. a tubular column housing rotatably mounted within said column frame;
   c. means on said column frame for rotating said column housing relative to said column frame about a vertical axis;
   d. a single stripping screw rotatably mounted within said column housing;
   e. means on the column housing for rotating said stripping screw relative to said column housing;
   f. a nut mounted on the threads of said stripping screw and non-rotatable relative to said column housing but free to travel vertically within and relative to said column housing;
   g. a bull nose fixably attached to said nut for penetrating a mold;
   h. a plurality of tongs pivotally attached to said column housing for holding a mold;
   i. means connecting said bull nose and tongs operable by movement of said nut for closing said tongs; and
   j. means on said column housing operable by gravity to open said tongs.

2. An ingot stripper as recited in claim 1 in which the means for opening and the means for closing the tongs comprises:
   a. a tong opening counterweight axially slidable about the column housing bearing on said tongs to open the same;
   b. a tong closing counterweight pivotally connected to said tongs in a first position so as to oppose and override said tong opening counterweight; and
   c. means cooperating with said nut for lifting the tong closing counterweight from said first position bearing on said tongs as said bull nose is raised to a second position in which the tong closing counterweight does not bear on said tongs and the tong opening counterweight is free to act on said tongs.

3. An ingot stripper as recited in claim 2 further comprising a power gripping linkage means connecting the bull nose and tongs for transferring the upward movement of the bull nose into a closing movement of said tongs.

4. An ingot stripper as recited in claim 3 in which the power gripping linkage means comprises:
   a. a load beam fixably attached to said tong closing counterweight; and
   b. a plurality of pressure shoes mounted on said load beam and bearing on said tongs, whereby raising said nut raises said tong closing counterweight which in turn raises said load beam and said pressure shoes mounted thereon and pivotally forces the tongs together.

5. An apparatus for stripping a metal ingot from its casting mold comprising:
   a. a column frame;
   b. a tubular column housing rotatably mounted within said column frame;
   c. means on said column frame for rotating said column housing relative to said column frame about a vertical axis;
   d. a stripping screw rotatably mounted within said column housing;
   e. means on the column housing for rotating said stripping screw relative to said column housing;
   f. a nut mounted on the threads of said stripping screw and non-rotatable relative to said column housing but free to travel vertically within said column housing;
   g. a bull nose fixably attached to said nut for penetrating a mold;
   h. a plurality of tongs pivotally attached to said column housing for holding a mold;
   i. means for opening and closing said tongs including a tong opening counterweight bearing on said tongs to open the same, a tong closing counterweight pivotally connected to said tongs so to oppose and override said tong opening counterweight and means for lifting the tong closing counterweight from bearing on said tongs as said bull nose is raised; wherein:
   j. said tong opening counterweight comprises a hollow cylinder mounted on the exterior of and guided by said column housing;
   k. said tong closing counterweight comprises a tubular member coaxially mounted within said column housing and guided by said bull nose; and
   l. said lifting means comprises a collar on said bull nose and an internally projecting flange on said tong closing counterweight engaging said collar to limit downward movement of said closing counterweight.

6. An ingot stripper as recited in claim 5 further comprising a power gripping linkage means connecting the bull nose and tongs for transferring the upward movement of the bull nose into a closing movement of said tongs.

7. An ingot stripper as recited in claim 6 in which the power gripping linkage means comprises:
   a. a load beam fixably attached to said tong closing counterweight; and
   b. a plurality of pressure shoes mounted on said load beam and bearing on said tongs, whereby raising said nut raises said tong closing counterweight which in turn raises said load beam and said pressure shoes mounted thereon and pivotally forces the tongs together.

8. In an apparatus for stripping a metal ingot from a casting mold comprising:
   a. a bull nose;
   b. a column housing;
   c. moving means on the column housing for raising and lowering said bull nose within said column housing;
   d. a plurality of tongs pivotally attached to said column housing for holding a mold;
   e. a tong opening counterweight bearing on said tongs to open the same;
   f. a tong closing counterweight pivotally connected to said tongs so to oppose and override said tong opening counterweight;
   g. means for lifting the tong closing counterweight from bearing on said tongs as said bull nose is raised;
   h. said tong opening counterweight comprising a hollow cylinder mounted on the exterior of and guided by said column housing;

i. said tong closing counterweight comprising a tubular member coaxially mounted within said column housing and guided by said bull nose; and j. said lifting means comprising a collar on said bull nose, and an internally projecting flange on said tong closing counterweight engaging said collar to limit downward movement of said closing counterweight.

9. An apparatus as recited in claim 8 further comprising power gripping linkage means connecting the bull nose and tongs for transferring the upward movement of the bull nose into a closing movement of said tongs.

10. An apparatus as recited in claim 9 in which the power gripping linkage means comprises:

a. a load beam fixably attached to said tong closing counterweight; and b. a plurality of pressure shoes mounted on said load beam and bearing pivotally on said tongs, whereby raising said moving means raises said tong closing counterweight which in turn raises said load beam and said pressure shoes mounted thereon and pivotally forces the tongs together.

* * * * *